US008743524B2

(12) United States Patent
Podporkin et al.

(10) Patent No.: US 8,743,524 B2
(45) Date of Patent: Jun. 3, 2014

(54) LIGHTNING ARRESTER AND A POWER TRANSMISSION LINE PROVIDED WITH SUCH AN ARRESTER

(75) Inventors: Georgy Viktorovich Podporkin, St. Petersburg (RU); Eugeny Sergeevich Kalakutsky, St. Petersburg (RU)

(73) Assignee: Otkrytoe Aktsionernoe Obschestvo "NPO Streamer", Sankt-Petersburg (RU)

( * ) Notice: Subject to any disclaimer, the term of this patent is extended or adjusted under 35 U.S.C. 154(b) by 492 days.

(21) Appl. No.: 13/145,302

(22) PCT Filed: Jan. 19, 2009

(86) PCT No.: PCT/RU2009/000006
§ 371 (c)(1),
(2), (4) Date: Sep. 2, 2011

(87) PCT Pub. No.: WO2010/082861
PCT Pub. Date: Jul. 22, 2010

(65) Prior Publication Data

US 2011/0304945 A1 Dec. 15, 2011

(51) Int. Cl.
*H01T 4/18* (2006.01)

(52) U.S. Cl.
USPC ..... 361/117

(58) Field of Classification Search
CPC ..... H01T 4/18; H01T 4/20
USPC ..... 361/117
See application file for complete search history.

(56) References Cited

U.S. PATENT DOCUMENTS 2,835,725 A * 5/1958 Nicholas ..... 174/142
3,184,646 A * 5/1965 Diebold ..... 361/676

(Continued)

FOREIGN PATENT DOCUMENTS

RU 2 191 454 C2 10/2002
RU 2 299 508 C2 5/2007
RU 2 312 441 C2 12/2007

OTHER PUBLICATIONS

A.C. Taev. Electric Arc in Low Voltage Apparatuses, Moscow, "Energiya" Publishing House, 1965, p. 85.

(Continued)

*Primary Examiner* — Ronald W Leja
(74) *Attorney, Agent, or Firm* — Birch, Stewart, Kolasch & Birch, LLP

(57) ABSTRACT

A lightning arrester for protecting elements of electrical facilities or a power transmission line comprises an insulating body which is made of a solid dielectric, preferably in the form of a bar, a strip or a cylinder, two main electrodes that are mechanically coupled to the insulating body and two or more intermediate electrodes. The intermediate electrodes, preferably made in the form of bars or cylinders, are arranged between the main electrodes so that said intermediate electrodes are mutually shifted along the longitudinal axis of the insulating body or along a spiral line. Such design makes it possible to form a discharge channel between the adjacent electrodes. Furthermore, said electrodes are located inside the insulating body and are separated from the surface of the body by an insulation layer. Discharge chambers formed as cavities or through bores opened to the surface of the insulating body are arranged between the pairs of the adjacent electrodes. Dimensions of the chambers are selected such that a discharge is easily blown out from the chambers to the surface of the insulating body, thereby increasing the efficiency of the discharge current quenching. In the preferred embodiments, the arrester is provided with an additional electrode for reducing a flashover voltage. Various embodiments of a power transmission line using the arrester of the invention are also disclosed.

25 Claims, 7 Drawing Sheets

(56) References Cited

U.S. PATENT DOCUMENTS

| | | | | |
|---|---|---|---|---|
| 3,504,226 | A * | 3/1970 | Stetson | 315/36 |
| 3,973,172 | A * | 8/1976 | Yost | 361/130 |
| 4,345,295 | A * | 8/1982 | Hasse et al. | 361/130 |
| 4,665,460 | A | 5/1987 | Schaff | |
| 4,796,153 | A | 1/1989 | Amason et al. | |
| 5,493,072 | A * | 2/1996 | Stevens | 174/143 |
| 6,108,187 | A * | 8/2000 | Podporkin et al. | 361/117 |
| 6,717,790 | B1 | 4/2004 | Morooka | |
| 7,643,265 | B2 * | 1/2010 | Loader et al. | 361/120 |
| 8,300,379 | B2 * | 10/2012 | Podporkin | 361/117 |
| 2004/0120091 | A1 | 6/2004 | Pilschikov et al. | |
| 2011/0102960 | A1 * | 5/2011 | Podporkin | 361/137 |
| 2011/0304945 | A1 * | 12/2011 | Podporkin et al. | 361/117 |

OTHER PUBLICATIONS

High Voltage Techniques. Ed. D. V. Razevig, Moscow, "Energiya" Publishing House, 1976, pp. 285-288.

* cited by examiner

Fig. 1
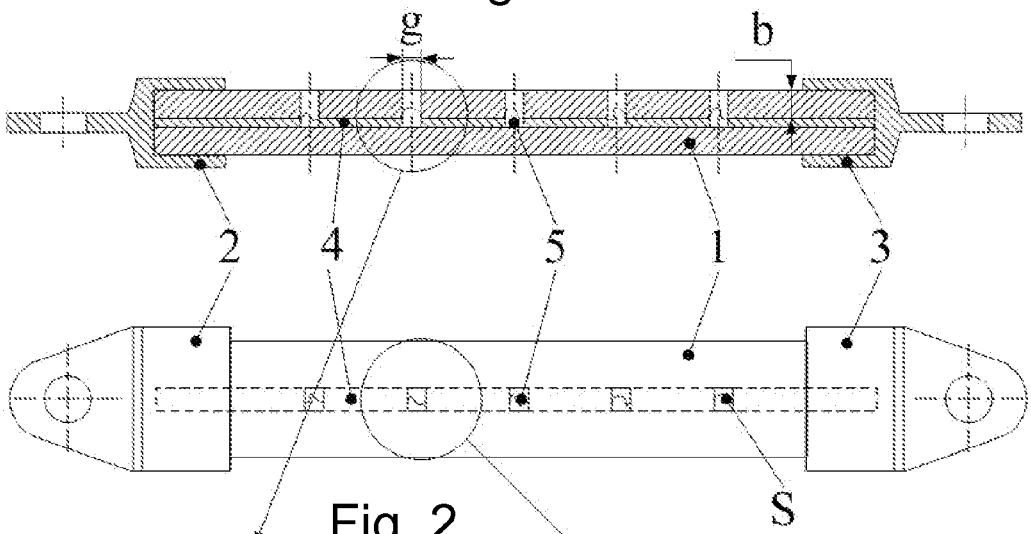
Fig. 2
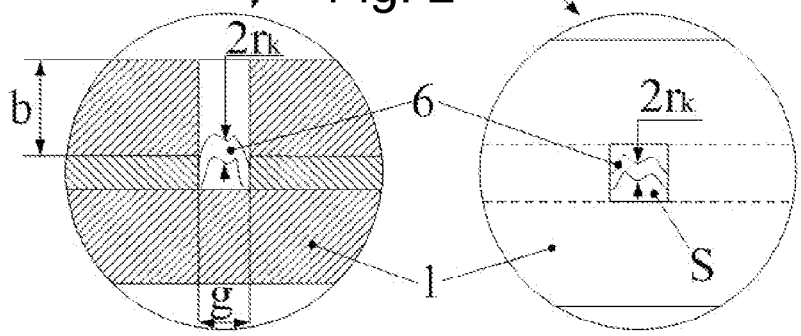
Fig. 3 Fig. 4

Fig. 5
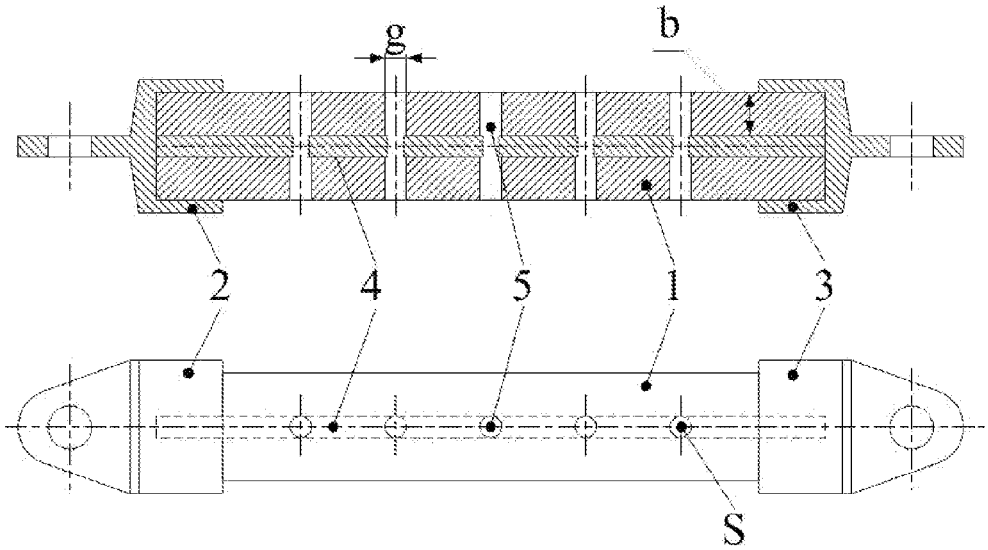
Fig. 6
Fig. 7
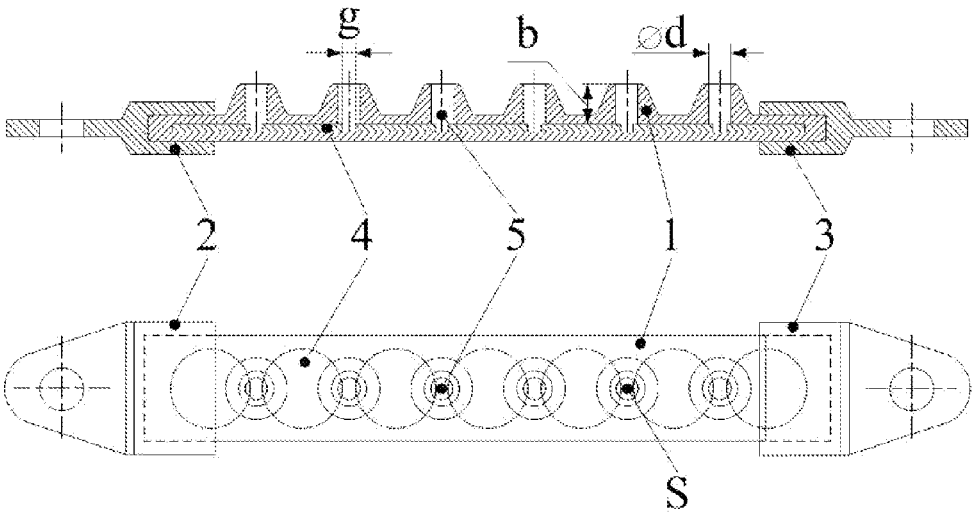
Fig. 8

Fig. 9
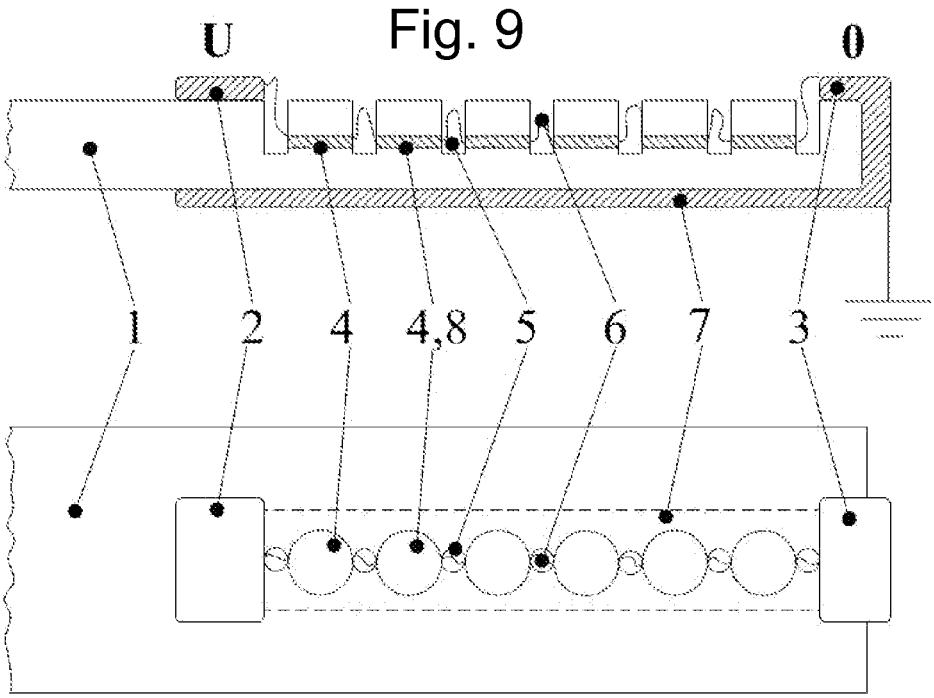
Fig. 10
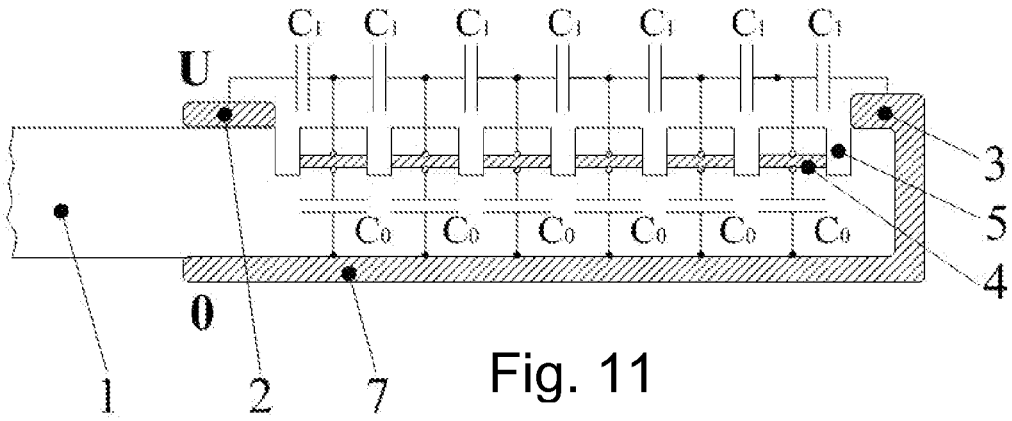
Fig. 11
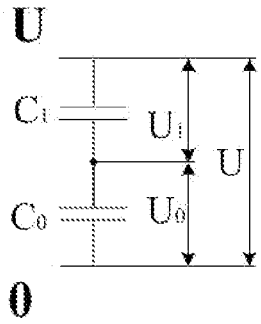
Fig. 12

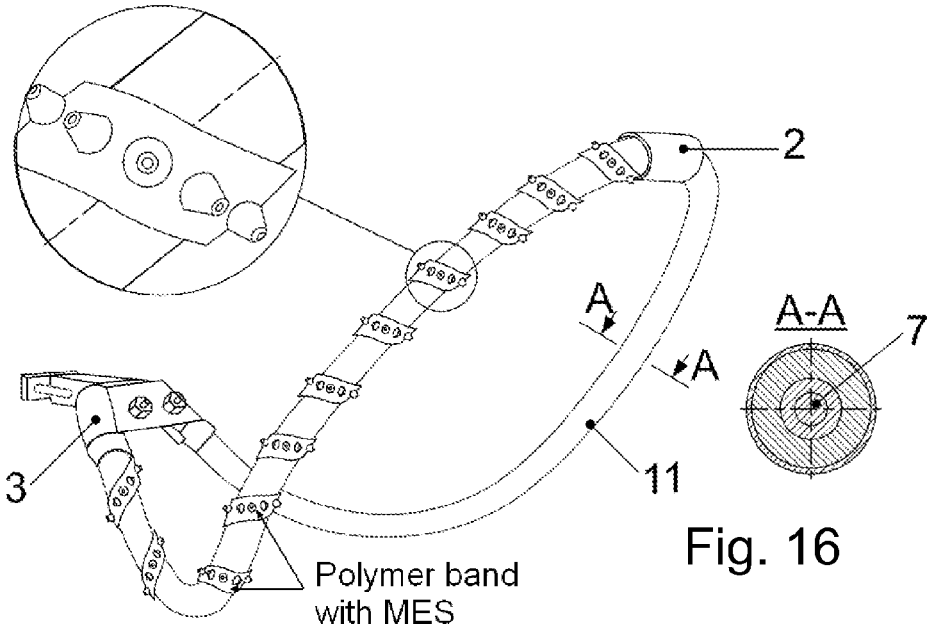
Fig. 16
Fig. 17
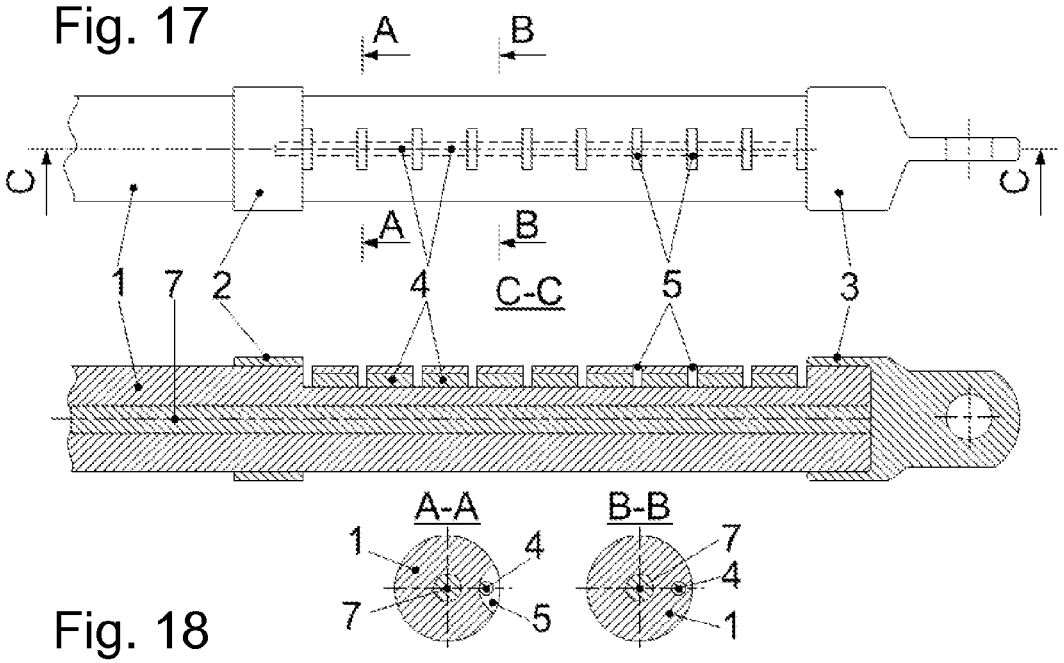
Fig. 18

LIGHTNING ARRESTER AND A POWER TRANSMISSION LINE PROVIDED WITH SUCH AN ARRESTER

FIELD OF INVENTION

The present invention relates to lightning arresters for protecting electrical equipment and high-voltage electric power lines (HEPL) against lightning overvoltages. Such arresters can be employed, for example, for protecting high-voltage installations, insulators and other HEPL elements, as well as various electrical facilities.

BACKGROUND ART

There is known a so-called tubular arrester for limiting overvoltages in an electric power line (cf. High voltage techniques. Ed. D. V. Razevig, Moscow, "Energiya" Publishing House, 1976, p. 287). A main element of the arrester is formed by a tube made of an insulating gas generating material. One end of the tube is plugged with a metal lid having an inner rod electrode fastened thereon. A ring-form electrode is located at an open end of the tube. A gap between the rod electrode and the ring-form electrode is called an inner, or arc quenching gap. One of the electrodes is grounded, while the second electrode is connected, via an external sparkover gap, to a conductor of the electric power line.

A lightning overvoltage results in a breakdown of both gaps, so that an impulse current is shunted to the ground. After the overvoltage impulse through the arrester has terminated, a follow current continues to flow, so that a spark channel transforms into an arc one. Due to a high temperature in a channel of the alternative arc current inside the tube, an intensive gas emission takes place providing a strong pressure increase. Gases, by flowing to the open end of the tube, create a longitudinal blowing, so that the arc is quenched when passing its zero value for the first time.

After a plurality of actuations of the arrester, the discharge chamber of the tube wears out. The arrester stops functioning properly and needs a replacement, which means an increase in maintenance costs.

There is also known an arrester for limiting overvoltages in an electric power line, the arrester being based on the use of a protective sparkover air gap formed between two metal rods (cf. High voltage techniques. Ed. D. V. Razevig, Moscow, "Energiya" Publishing House, 1976, p. 285). One of the rods in the prior art arrester is connected to a high-voltage conductor of an electric power line, while the second rod is connected to a grounded structure, for example, to a support (such as a tower or a pole) of the electric power line. In case of the overvoltage, a sparkover gap breaks down, so that a lightning overvoltage current is shunted to the ground, and the voltage applied to the device drops rapidly. In this way, both shunting the lightning current and limiting the overvoltage are attained. However, arc quenching ability of a single gap is small, so that after the termination of the overvoltage, a power arc follow current continues to flow through the sparkover gap. Therefore, a shut-off device must be activated for breaking a circuit, such breaking being quite undesirable for consumers receiving electric power from this electric line.

There is further known an arrester that differs from the above-described one in that a third, intermediate rod electrode is placed between a first main rod electrode and a second main rod electrode (cf., for example, U.S. Pat. No. 4,665,460, H01T 004/02, 1987). Thus, instead of a single sparkover air gap, two such gaps are formed. This feature made it possible to improve somewhat arc quenching ability of the arrester and to ensure, with the aid of the arrester, quenching of moderate follow currents (of the order of tens amperes) in cases of single phase-to-ground short circuits. However, this arrester is unable to quench currents exceeding 100 A, which currents are typical for two- or three-phase-to-ground short circuits in lightning overvoltage cases.

As the closest prior art for the invention, an arrester intended for the lightning protection of elements of electrical facilities or an electric power line and supplied with a so-called multi-electrode system (MES) disclosed in RU 2299508, H02H 3/22, 2007 may be indicated. The prior art arrester comprises an insulating body made of a solid dielectric, two main electrodes mechanically coupled to the insulating body, and also two or more intermediate electrodes. The intermediate electrodes, which are arranged between the main electrodes, are mutually displaced, at least, along the longitudinal axis of the insulating body. They are configured to enable a streamer discharge to occur between each of the main electrodes and the intermediate electrode adjacent to said each of the main electrodes, as well as between adjacent intermediate electrodes.

Owing to breaking a distance between the main electrodes into a plurality of sparkover gaps, this arrester possesses a higher arc quenching ability than devices with a single discharge gap or with just a few of such gaps (cf. for example, A. C. Taev. Electric arc in low voltage apparatuses, Moscow, "Energiya" Publishing House", 1965, p. 85).

Nevertheless, the arc quenching ability of the prior art arrester is not high enough, so that its application is limited to the lightning protection of the HEPLs of voltage class 6-10 kV. Such arrester is difficult to use in the lightning protection of the HEPLs of higher voltage classes for the reason the number of the intermediate electrodes and the arrester size become too large.

DISCLOSURE OF THE INVENTION

It is therefore an object of the present invention to provide an arrester with a high reliability, low manufacturing and maintenance costs, low flashover voltages and a high current quenching effectiveness. Such features will make it possible to employ the arrester of the invention for the lightning protection of the HEPLs of the higher voltage classes (20 to 35 kV and higher), and also to improve technical and economic characteristics of the arresters of the voltage class 3-10 kV.

In other words, the invention is directed to improving reliability and simplifying a design of the lightning arresters.

The above-specified object is attained essentially by providing an arrester for the lightning protection of electrical facilities or of an electric power line, the arrester comprising an insulating body made of a solid dielectric, two main electrodes mechanically coupled to the insulating body, and two or more intermediate electrodes configured to enable a discharge (for example a streamer discharge) to occur between each of the main electrodes and the intermediate electrode adjacent to said each of the main electrodes, wherein said adjacent electrodes are placed between the main electrodes and are mutually displaced, at least along the longitudinal axis of the insulating body. In some embodiments, a line along which the mutually displaced intermediate electrodes are arranged may coincide with the longitudinal axis of the insulating body. The arrester according to the invention is characterized in that the intermediate electrodes are located inside the insulating body and are separated from a surface thereof by an insulation layer having a thickness exceeding a precalculated diameter $D_k$ of a channel of said discharge, wherein a plurality of discharge chambers (or cavities) are formed between the adjacent intermediate electrodes, the discharge chambers being open to a surface of the insulating body, and wherein a cross-sectional area S of the discharge chambers in a zone of the discharge channel formation is selected to satisfy a condition $S<D_K \cdot g$, where g is a minimal distance between the adjacent intermediate electrodes.

Depending on a particular arrester embodiment and a selected technology of manufacturing the arrester, the discharge chambers may be configured as cavities or through bores formed in the insulating body. Such recesses or bores can have cross-sections (that is sections by a plane normal to the axis of the discharge chamber) of various appropriate shapes, i.e. circular, rectangular, slit-shaped, etc. enabling the discharge chambers to perform their functions (to be described below). In some embodiments, the cross-section of the discharge chamber can have a size varying along a depth of the chamber (i.e. a size increasing in a direction of the surface of the insulating body).

An important condition of ensuring attainment of the above-specified object of the invention consists in an optimal selection of the discharge chambers sizes. More specifically, a discharge chamber length determining a minimal distance g between the adjacent electrodes shall be preferably selected depending on a particular application of the arrester, because it is the application that determines such parameters of the arrester as a type of structures to be protected, a voltage class, etc. For example, in the arresters intended for the protection of the HEPLs of middle voltage classes (6 to 35 kV) from a lightning stroke, a value of g may be selected in a range from 1 mm to 5 mm, while in case the arrester of the invention shall be used for protecting the HEPLs of high and super high voltage classes, the value of g shall be increased and preferably selected in a range from 5 mm to 20 mm.

In some embodiments of the arrester, it can be additionally provided with the discharge chambers formed between each of the main electrodes and the intermediate electrodes adjacent thereto.

As for configuring the insulating body, it is preferably (in particular for ensuring easiness of manufacture) to shape it as a bar, a strip or a cylinder. Cost parameters of the arrester can be additionally improved by using an embodiment thereof requiring less material due to providing the insulating body with bulges in zones in which the discharge chambers open to the surface of the insulating body. Such solution makes it possible to provide a required thickness of the insulation layer only in zones surrounding the discharge chambers, while in sections between such zones the thickness of said layer may be substantially reduced.

With the aim of ensuring easiness of manufacture of the arrester, the intermediate electrodes preferably are shaped as plates or cylinders, for example made of a metal, graphite or carbon fiber.

In order to satisfy an important requirement of a low flashover voltage of the arrester according to the invention, it is proposed to provide it with an additional electrode connected with one of the main electrodes, and to arrange this additional electrode on a surface of the insulating body opposite to the surface to which the discharge chambers are opened, or inside the insulating body. In the last case, it may be advantageous, from the design considerations, to provide the insulating body with a hollow component, and to place the additional electrode inside such hollow component. Configured in this way, both the hollow component of the insulating body and the additional electrode preferably shall have a circular cross-section. This will make it possible to produce the arrester according to the invention using a piece of electrical cable, with a core and a solid insulation of the cable forming respectively the additional electrode and the hollow component of the insulating body, with both this electrode and the hollow component having the same length. In a general case, a length of the additional electrode corresponds to at least a half of the distance between the main electrodes. Electrical strength of the insulation between the additional electrode and the main electrode not connected therewith is selected to be larger than a precalculated flashover voltage between the main electrodes.

The intermediate electrodes can be embedded inside a strip of an insulating material forming a part of the insulating body. Such solution simplifies arranging the intermediate electrodes along an optimal path. For example, the flexible strip comprising the electrodes can be fixed to a surface of the hollow component of the insulating body in such a way that the intermediate electrodes will be arranged parallel to the longitudinal axis of the insulating body. Alternatively, the flexible strip with the intermediate electrodes can be helically wound around a surface of a cylindrical hollow component, so that the intermediate electrodes are mutually displaced along a line having a form of a spiral. The latter embodiment makes it possible to increase a total number of the intermediate electrodes of the arrester without increasing its total length and thereby to improve additionally the arc quenching ability of the arrester.

In an alternative embodiment, the arrester according to the invention can be employed in a combination with a prior art long-flashover arrester of a loop type (LFAL). In this embodiment, the hollow component of the insulating body can have a U-shape profile, wherein the first main electrode can be configured as a metal tube enclosing a curved part of the hollow component. The second main electrode can be mechanically coupled with one or with both ends of the hollow component of the insulating body and electrically connected with the additional electrode. In this embodiment, a metal rod of the LFAL functions as the additional electrode. Therefore, the additional electrode has a length equal to the length of the insulating body. The intermediate electrodes can be arranged on one or both arms of the insulating body.

One more object of the present invention consists in providing an electric power line with a reliable lightning protection to be achieved by supplying the line with reliable and low-cost lightning arresters configured for low flashover voltages and for a high arc quenching ability.

This object is attained by providing an electric power line comprising: supports provided with insulators, at least one live conductor coupled to the insulators by fastening means, and at least one arrester for the lightning protection of elements of the electric power line. In accordance with the invention, such arrester (preferably, each of a plurality of such arresters) is configured as the arrester according to the present invention. According to preferred embodiments of the invention, one of the main electrodes of at least one or of each of the arresters according to the invention is connected, either directly or via a sparkover gap, to an element of the electric power line to be protected, while another main electrode is connected, either directly or via a sparkover gap, to the earth.

In case the live conductor of the electric power line according to the invention is located inside a protective insulation layer, a segment of this conductor adjacent to an insulator of the electric power line and located between the main electrodes of the arrester can be used as the additional electrode, while a corresponding segment of the protective layer can be used as the hollow component of the insulating body. In this embodiment, the first main electrode will be configured as an armored clamp arranged on said protective insulation layer segment and electrically connected with an end of said conductor segment (that is with the additional electrode). The second main electrode will be arranged on a surface of the protective insulation layer (that is of the hollow component of the insulating body) and electrically connected with the metal fastening means for securing the conductor. In this embodiment, the intermediate electrodes of the arrester are preferably embedded inside a strip of an insulating material attached to the surface of said segment of the protective insulation layer.

One of the preferred embodiments of the electric power line according to the invention employs an arrester embodiment with the insulating body and the additional electrode having circular cross-sections, wherein the additional electrode of the arrester is configured as a rod of the insulator installed directly on the arrester. The insulating body of this arrester embodiment is configured as an insulator cap of the type usually employed for securing the insulator on the rod.

BRIEF DESCRIPTION OF THE FIGURES

Reference will now be made to the accompanying drawings wherein:

FIG. 1 is a front view, in a cross-section, of an arrester embodiment having a flat insulating body;

FIG. 2 is a view from above of the embodiment shown in FIG. 1;

FIG. 3 is a front view, in a cross-section, of a fragment of the embodiment shown in FIG. 1;

FIG. 4 is a view from above of the fragment shown in FIG. 1;

FIG. 5 is a front view, in a cross-section, of another arrester embodiment according to the invention having a cylindrical insulating body;

FIG. 6 is a view from above of the embodiment shown in FIG. 5;

FIG. 7 is a front view, in a cross-section, of a still another arrester embodiment according to the invention having the insulating body with bulges in zones where discharge chambers open to a surface of the insulating body;

FIG. 8 is a view from above of the embodiment shown in FIG. 7;

FIG. 9 is a front view, partially in section, of an arrester embodiment comprising a flat insulating body and an additional electrode;

FIG. 10 is a view from above of the embodiment shown in FIG. 9;

FIG. 11 shows a fragment of a simplified circuit diagram of the embodiment shown in FIG. 9;

FIG. 12 illustrates a distribution of voltages between the electrodes of the arrester;

FIG. 16 shows an arrester embodiment comprising a hollow component of the insulating body and an additional electrode, both shaped as a loop;

FIGS. 17 and 18 are respectively a front view and view from above of an arrester embodiment with the intermediate electrodes welded inside an insulation layer of a cable piece;

BEST MODE FOR CARRYING OUT THE INVENTION

Figures 13, 14:
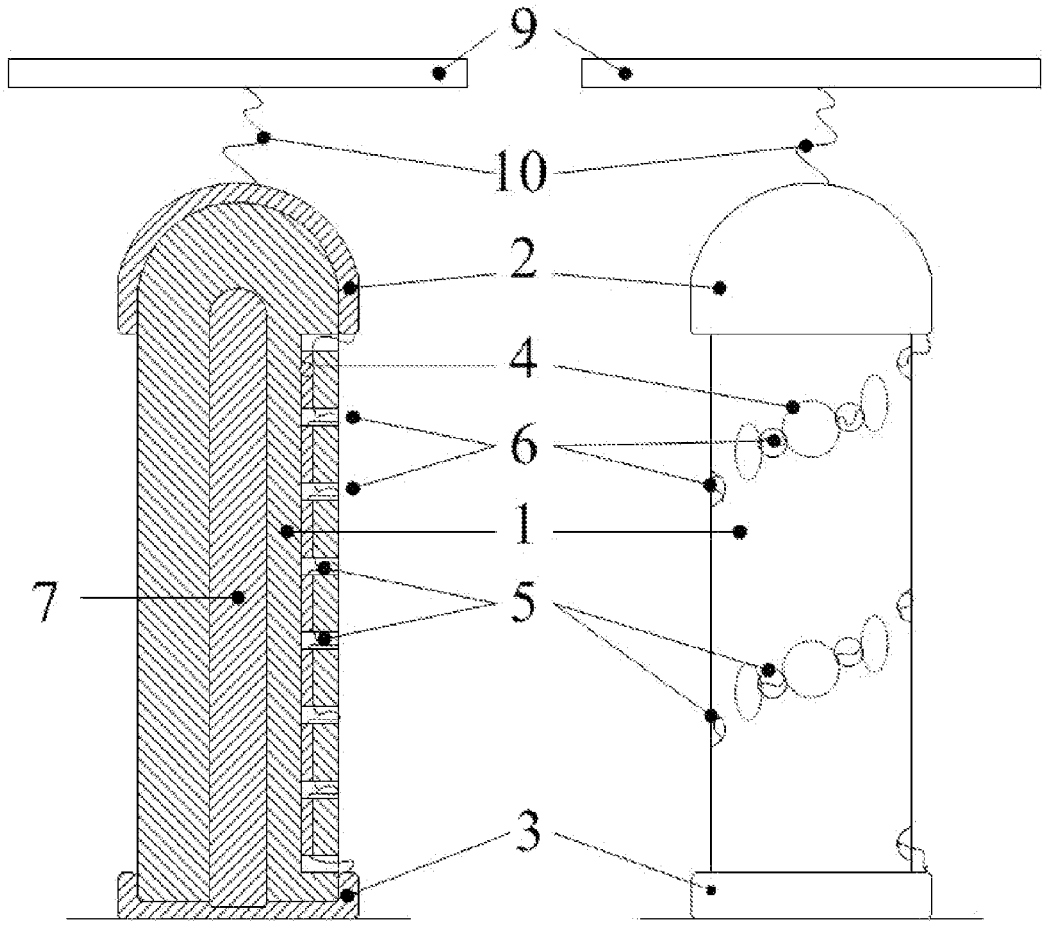
FIG. 13 shows, in a cross-section, the arrester embodiment with both the insulating body and the additional electrode shaped as a cylinder with a rounded upper end.
FIG. 14 presents a modification of the embodiment shown in FIG. 13 having the intermediate electrodes arranged in a spiral.

With reference to FIGS. 1 to 4, an arrester according to the invention comprises an elongated flat insulating body 1 made of a solid dielectric, for example, of polyethylene. The first and the second main electrodes 2, 3 are respectively installed on both ends of the insulating body 1. Due to such arrangement, both main electrodes are mechanically coupled to the insulating body. Inside the insulating body 1 m intermediate electrodes 4 are located. A minimal value of m equals two, while an optimal number of the intermediate electrodes is selected depending on their particular configuration, a precalculated overvoltage and other conditions of their functioning. The arrester embodiment shown in FIGS. 1 to 4 comprises 5 intermediate electrodes 4 configured as rectangular plates mutually displaced along the longitudinal axis of the arrester (this axis connects main electrodes 2, 3). A sparkover air gap is formed between each pair of adjacent intermediate electrodes 4, this gap determining a distance between the adjacent electrodes (measured along the line connecting said adjacent electrodes). According to the invention, the length of the sparkover gap shall not be less than the minimal distance g between the electrodes 4 selected depending on particular conditions of the arrester's functioning as will be described below. Each such sparkover gap is located in a discharge chamber 5 that opens to a surface of the insulating body 1.

For protecting high-voltage installations or electric power lines, one of the main electrodes (for example, the first main electrode 2) of the arrester directly or via a sparkover gap is connected to a high-voltage element of an installation or of an electric power line, for example, to a line conductor (not shown in FIGS. 1 to 4), so as to be connected in parallel with an electrical element to be protected, for example, with an insulator (not shown in FIGS. 1 to 4). By its other, respectively the second main electrode 3 the arrester directly or via a sparkover gap is connected to the ground.

When an overvoltage impulse impacts the arrester, a discharge develops therein from the first main electrode 2 towards the second main electrode 3, causing sequential breakdowns of the sparkover gaps between the intermediate electrodes 4. This discharge, depending on conditions of its development, can be of different types, i.e. such as a streamer discharge, an avalanche discharge or a leader discharge. With the aim to ensure better understanding of the invention and specific implementations thereof, only an embodiment of the invention employing the streamer discharge will be considered below, even though the invention is fully applicable to other discharge types. In the process of its inception and development, a spark channel 6 expands with a supersonic velocity. As will be described in detail below, if volumes of the spark discharge chambers 5 formed between the intermediate electrodes are made small enough, a development of the discharge will result in creating a high pressure inside the chambers. Under the action of this pressure, the spark discharge channels 6 formed between the intermediate electrodes will be driven towards the surface of the insulating body (as shown schematically in FIGS. 1 and 3) and then will be ejected from the chambers into the air around the arrester. Owing to such blow-out action which results in lengthening the channels between the intermediate electrodes, a total electrical resistance of all channels will increase. As a result, a total resistance of the arrester itself will also increase and, and this will limit the lightning overvoltage impulse current. After termination of the lightning overvoltage impulse, a voltage at an operational frequency will remain applied to the arrester. However, because the arrester has a large electrical resistance, the discharge channel will break into a plurality of elementary channels between the intermediate electrodes, the discharge is quenched, being unable to support itself.

In order to attain a high quenching effectiveness, parameters of the arrester according to the invention, especially such parameters as a minimal distance g between the adjacent electrodes separated by the discharge chamber 5, as well as width of the discharge chambers 5 in a zone of inception of the discharge and thickness b of the insulation layer, shall be selected depending on precalculated characteristics of the discharge (in particular, on the discharge current and its steepness, as well as on a precalculated discharge diameter). As will be shown below, the discharge diameter can be estimated with sufficient accuracy basing on requirements to the arrester following from its purpose, that is by the characteristics and use conditions of an element of a high-voltage equipment or a HEPL to be protected by the arrester.

More specifically, when selecting design parameters of the arresters employed for the HEPL protection, it is necessary to take into consideration that two substantially different regimes of their functioning are possible depending on whether a lightning strikes in the vicinity of a high-voltage electric power line or directly at said power line.

The first regime corresponds to protecting the HEPL from induced overvoltages, i.e. from the overvoltages which develop when the lightning strikes in the vicinity of the HEPL. Such overvoltage is characterized by relatively limited amplitudes, not exceeding 300 kV, and by a short duration (about 2 to 5 μs). The current has an amplitude of the order of 1 to 2 kA, while the current derivative, di/dt, at the pulse front is in a range of 0.1 to 2 kA/μs. As was shown in laboratory experiments, in relation to this regime and to the streamer-type discharge, an optimal length of the sparkover gap lies in a range of 0.1 to 2 mm. The induced overvoltages are dangerous only for electric lines of the middle voltage class, i.e. for 6 to 35 kV HEPLs, the induced overvoltages being the main reason of lightning outages for these lines. A direct lightning strokes (DLS) are rather rare events because of relatively small heights of the HEPL supports. Therefore, for protecting HEPL elements from the induced overvoltages, it is expedient to use the arresters with g=0.1-2 mm.

The DLS at a single-standing, well grounded object can result in a lightning current ranging up to more than 100 kA, with discharge duration of 50 to 1000 μs and with the current derivative, di/dt, at the pulse front up to 20 kA/μs. The DLS at a HEPL line conductor can lead, in theory, to voltages of up to 10 MV. However, the DLS at the HEPL of middle voltage class protected by the lightning arresters electrically connected in parallel to each insulator results in actuating the arresters on several supports, due to limited distances between the supports (50 to 100 m) and to a relatively low insulation level of the electric line (100 to 300 kV). Therefore, the lightning current branches between several supports, with additional branching at the supports into three components between lightning arresters associated with each of current phases. As found in field measurements, the current through one support does not exceed 20 kA. For such current levels, it is preferable to increase, to 4-5 mm, the minimal distance g between the adjacent electrodes separated by the discharge chambers, in order to avoid development of conducting channels formed from a molten metal of the electrodes.

In HEPLs of high voltage class (110-220 kV), the distances between the supports are in a range of 200 to 300 m, while the insulation level corresponds to 500-1000 kV. Therefore, in case of the DLS, shunting the lightning current is performed by the arresters of one or two supports, so that the current through one arrester does not exceed 40 kA. For this reason, the value of g in such HEPLs is preferably selected in a range of 5-10 mm.

In HEPLs of super high voltage class (330-750 kV), the distances between the supports reach 400 to 500 m, while the insulation level corresponds to 2000-3000 kV. Therefore, in case of the DLS, the arresters of the single support or only one arrester of a phase struck by the lightning participate(s) in shunting the lightning current. In such cases, the current through one arrester can attain 60 to 100 kA. For the HEPLs of this type, the value of g is preferably selected in a range of 10 to 20 mm.

In view of the above data, when the arrester according to the invention is employed for protecting elements of the HEPLs of the middle voltage class, the minimal distance g between the adjacent electrodes separated by the discharge chamber is preferably selected in a range of 0.1 to 5 mm. In case the arrester according to the invention is intended for protecting elements of the HEPLs of the high or super high voltage class, the distance g is preferably selected in a range of 5 mm to 20 mm.

An assessment of a cross-sectional area S of the discharge chambers and an insulation thickness b may be made basing on the following considerations.

An estimated radius $r_\kappa$ of a streamer channel for a discharge in air under normal conditions may be determined according to the formula proposed by S. I. Braginsky (cf. High voltage techniques: Textbook for Universities Ed. G. S. Kuchinsky, St. Petersburg, "Energoatomizdat", 2003, p. 88):

$$r_\kappa \approx 0{,}1\left(\frac{di}{dt}\right)^{\frac{1}{3}} t^{\frac{5}{6}}, \tag{1}$$

where t is time, in seconds; di/dt is a rate of a current pulse rise, in amperes per second.

The Table below comprises values of the radius $r_\kappa$ calculated according to the formula (1) for various, the most representative, values of di/dt and t. It may be noted that the channel radius $r_\kappa$ and, respectively, its diameter $D_k=2r_\kappa$ are functions of time, which means they increase with time. The calculated data are arranged in order corresponding to a gradual increase of the streamer channel radius.

TABLE

Initial values and calculated results for $r_K$.

| No. | di/dt, kA/μs | t, μs | $r_K$, mm | $D_k$, mm | Reason for overvoltage occurrence |
|---|---|---|---|---|---|
| 1 | 0.1 | 1 | 0.5 | 1.0 | Induced |
| 2 | 1 | 2 | 1.8 | 3.6 | overvoltages |
| 3 | 10 | 1 | 2.2 | 4.4 | Direct lightning |
| 4 | 20 | 1 | 2.7 | 5.4 | stroke at conductor, repeated stroke |
| 5 | 0.1 | 10 | 3.2 | 6.4 | Lightning stroke at |
| 6 | 1 | 10 | 6.8 | 13.6 | support and back flashover |
| 7 | 10 | 10 | 4.7 | 9.4 | Direct lightning |
| 8 | 20 | 10 | 18.5 | 37 | stroke at conductor, first stroke |

Presented values for t correspond to pulse front durations for the most representative cases of the arrester employment:

1) for induced overvoltages (when a lightning strikes in the vicinity of an electric line); 2) for repeated strokes in case of a direct lightning stroke at a line conductor; 3) for a lightning stroke at the HEPL, with a back flashover of insulation (for example, of an insulator stack) following; 4) a direct lightning stroke at the HEPL conductor. The di/dt values presented in the Table also correspond to the above-identified cases.

Obviously, when estimating radius (diameter) of the channel for the streamer (or another type) discharge, it is possible to use different calculating formulas or experimental methods optimized for specific applications of the arrester and/or for particular embodiments of the arrester according to the invention (for example, for particular shapes of the discharge chambers or particular designs of the intermediate electrodes). However, as was confirmed by laboratory experiments, calculations based on formula (1) produce acceptable results practically for all embodiments of the arrester in the scope of the attached set of claims.

To guarantee that an excessive pressure develops inside the discharge chamber in the course of a discharge, certain conditions shall be met. These conditions will be examined below in relation to an arrester embodiment with the intermediate electrodes configured as plates and with the discharge chambers shaped as parallelepipeds (see FIG. 1). The streamer discharge originates between those points on the adjacent intermediate electrodes, which correspond to a maximal field strength (in the embodiment of FIG. 1 such points coincide with corners of the intermediate electrodes). When the streamer develops, a discharge channel expands radially from its axis at a supersonic velocity. If a streamer channel diameter becomes larger than the discharge chamber depth h, that is $$D_\kappa > h = b + a, \tag{2}$$

where b is the thickness of the insulation layer; a is the thickness of the electrode, then the discharge starts to move along walls of the discharge chamber outside of the chamber, which movement contributes to cooling and, therefore, to quenching of the discharge. It follows that the minimal insulation thickness contributing to quenching is defined as $$b = D_\kappa - a, \tag{3}$$

where a is the electrode thickness. The larger is the insulation thickness b, the stronger blowing will be generated in the process of the streamer channel expansion, and the more intensive channel cooling and quenching will follow. Therefore, to improve quenching reliability, the value of b is preferably selected as exceeding the estimated channel diameter $D_k$.

On the other side, increasing b values results in increasing gas pressure on the walls of the discharge chambers, and this can lead to the arrester destruction. The optimal insulation thickness b can be determined, by calculations and/or experimentally, when working out a specific arrester embodiment depending on its application and employed materials. However, by taking the electrode thickness a to be approximately 1 mm, it is possible, by using formula (3) and the data from the Table, to determine that this thickness b lies in the range from 1 mm to approximately 35-40 mm.

An estimated area of a streamer channel longitudinal section corresponds to $D_\kappa \cdot g$. In case the discharge chamber width is less than $D_k$, so that $$S < D_\kappa \cdot g, \tag{4}$$

the streamer will span the whole discharge chamber width before its diameter will reach the estimated value $D_k$. In other words, the streamer discharge will cover the whole cross-sectional area S of the discharge chamber. As a result, the streamer channel will be blown out outside of the discharge chamber which will lead to accelerated quenching.

By inserting in (4) appropriate values of the diameter $D_k = 2r_\kappa$, where values of the streamer channel radius $r_\kappa$ are taken form the Table ($r_\kappa$=0.5-18 mm and g=0.1 to 20 mm), concrete values and possible ranges for cross-sectional areas of the discharge chambers may be easily determined:

$$S \le 2r_\kappa \cdot g = 2(0.5 \div 18) \cdot (0.1 \div 20) = 0.1 \div 720 \approx 0.1 \div 700 \text{ mm}^2 \tag{5}$$

In some respects, a spark discharge quenching mechanism is similar to that for the arc discharge inside the tubular arrester described in the BACKGROUND ART portion above, but there exists an important difference consisting in that the arc (having a temperature of about 20,000° C.) burns inside the tubular arrester for a relatively long time (up to 10 ms). Such arc burns out the walls of the gas generating tube, and gases formed in the course of a thermal destruction are blown out outside the discharge channel. In the arrester according to the invention, the spark discharge quenching takes place immediately on termination of the lightning overvoltage impulse, the average duration of this impulse being of the order of 50 μs, that is about three orders of magnitude less than the duration of the arc burning. Moreover, the streamer channel temperature does not exceed 5,000° C., so it is about four times less than the arc temperature. Owing to these two factors, there is no erosion of the arrester according to the invention even after a number of actuations thereof.

The following variants of the arrester applications are relevant for a practical use:

1) for protection of the HEPLs of middle voltage class (MV) 6-35 kV from the induced overvoltages (see the Table, lines 1 and 2);
2) for protection of the HEPLs of high voltage class (HV) 110-220 kV and super high voltage class (SHV) 330-7500 kV from the reverse flashovers in cases a lightning protection wire rope is used (see the Table, lines 5 and 6);
3) for protection of HEPLs of high voltage class 110-220 kV and super high voltage class (SHV) 330-7500 kV from the direct lightning strokes at the transmission line conductor (see the Table, lines 3, 4 and 7, 8) and from the back flashovers (see the Table, lines 5 and 6) in cases the lightning protection wire is not used.

When designing the arresters, the heaviest conditions of their use in the HEPLs of a certain class, that is the largest values of the rates of current pulse rise, di/dt, and time t shall be taken into account. Thus, when designing the arrester for protecting the 6-35 kV HEPL from the induced overvoltages, data presented in line 2 of the Table (t=2 μs and $r_\kappa$=1.8 mm respectively) shall be used in calculations. Further, according to the invention, the thickness b of the insulation layer preferably shall be made larger than the channel diameter $D_k$ at the moment the voltage is at its maximum, for example, $b > D_k = 2r_\kappa = 2 \cdot 1.8 = 3.6$ mm. The cross-sectional area of the discharge chamber S according to the invention shall be selected as $S < D_\kappa \cdot g = 2 \cdot 3.6 = 7.2$ mm$^2$. For example, the discharge chamber with the circular cross-section shall have a diameter $$d \le \sqrt{\frac{4S}{\pi}} = \sqrt{\frac{4 \cdot 7{,}2}{3{,}14}} = 3 \text{ mm.}$$

Experimental studies have shown that in embodiments for applications according to variant 1, that is for protecting the 10 kV HEPL and the 20 kV HEPL from the induced overvoltages, the following arrester parameters can be selected, respectively: a number of the discharge chambers m=50; g=2 mm; b=4 mm; d=3 mm; S=7 $mm^2$ (embodiment 1) and m=150; g=3 mm; b=4 mm; d=3 mm; S=7 $mm^2$ (embodiment 2).

It shall be further noted that in the arrester according to the invention limitations exist only in relation to the minimal distance between the adjacent electrodes separated by the discharge chamber, on minimal insulation thickness, and on maximal cross-sectional area of the discharge chamber. Therefore, the arrester design can be optimized for particular variants of its use, by varying the above-indicated parameters, as well as shapes of the discharge chambers in a sufficiently wide range.

FIGS. 5, 6 illustrate an arrester embodiment having a cylindrical insulating body 1 and discharge chambers 5 extending from intermediate electrodes 4 to an upper surface and to a lower surface of the insulating body 1. Thus, the discharge chambers 5 are configured as through openings formed in the insulating body 1 to determine air discharge gaps between the intermediate electrodes 4. The cross-section of the discharge chamber can have a rectangular form (as shown in FIGS. 1 to 4), a circular form (as shown in FIG. 6) or some other form. The embodiment shown in FIGS. 5, 6 is easier to manufacture than the embodiment shown in FIGS. 1 to 4 because it permits to use, in the manufacturing process, highly efficient hydro-abrasive cutting of employed materials, which cutting ensures fast and accurate forming the through openings.

In the through discharge chambers (open to both surfaces of the insulating body) a pressure developing in the chamber when the discharge channel expands is lower than in the chambers shaped as cavities (opening only to one surface of the insulating body); for that reason, a discharge channel velocity and, therefore, quenching efficiency in such chambers is not so high as in the chambers of the other type. However, they have a better functional reliability because of a lower probability of the discharge chamber disruption due to an excessive pressure. This applies also to the slit-shaped chambers. They have a lower quenching efficiency, but their electrodynamic strength (that is capability to withstand large currents, for example, in case of a DLS at a line) is higher. For that reason, a proper selection of a type and shape of the discharge chambers shall depend on an intended use of the arrester (for example, for protection from induced overvoltages or from the DLS) and on manufacturing technology and costs considerations.

FIGS. 7, 8 illustrate an arrester embodiment with the insulating body 1 shaped as a flexible strip with bulges in zones where the discharge chambers 5 open to a surface of the insulating body 1 and with the intermediate electrodes 4 configured as circular metal or graphite washers. This embodiment is characterized by the most economical use of an insulating material employed for producing the insulating body 1. Indeed, it is necessary to ensure a required insulation thickness b determining a size of the discharge chamber along its axis only in zones where the discharge chamber opens to the surface of the insulating body.

FIGS. 9, 10 illustrate an arrester embodiment with a flat insulating body 1 and with an additional electrode 7. The first main electrode 2 is to be connected to an element of a high-voltage electric power line, for example, to a line conductor to which a high voltage potential is applied; the second main electrode 3 is to be connected to the ground having zero potential. In this embodiment, as a supplement to the discharge chambers 5 between the intermediate electrodes 4, additional discharge chambers are formed between each of the main electrodes 2, 3 and the intermediate electrode 4 adjacent thereto. The additional discharge chambers can be configured similar to the discharge chambers between the intermediate electrodes. However, in some embodiments of the arrester according to the invention, parameters of such additional discharge chambers can be modified considering that the discharge channel length in these chambers can exceed a length of a similar channel in the remaining discharge chambers.

The additional electrode 7 is electrically connected to the second main electrode 3 and so it also has a zero potential. Therefore, a high voltage applied between the main electrodes 2 and 3 is also applied between the first main electrode 2 and the additional electrode 7. A width of the flat insulating body 1 is selected such that electrical strength along the shortest distances between the electrodes 2 and 7 on the upper and lower surfaces of the flat insulating body are higher than between the main electrodes 2 and 3. Insulating features of a material used for producing the insulating body 1 and thickness thereof shall be selected in such a way that an electrical strength along said distances was higher than flashover voltage between the main electrodes 2 and 3 of the arrester. This is a necessary condition for ensuring that in case of the overvoltage the discharge will develop from the main electrode 2 via the sparkover gaps between the intermediate electrodes 4 to the second main electrode 3, instead of directly between the main electrode 2 and the additional electrode 7. Owing to a presence of the additional electrode, this arrester embodiment is characterized by low flashover voltages, so that it becomes possible to limit the overvoltage to quite a low level. The way the additional electrode influences the flashover voltages is explained with a reference to FIGS. 11 and 12.

FIG. 11 shows a fragment of a basic circuit diagram of the arrester embodiment presented in FIG. 9, the fragment including the first main electrode 2, the adjacent intermediate electrode 4 and the additional electrode 7. Capacitances $C_1$ and $C_0$ exist respectively between the electrodes 2 and 4 and between the electrodes 4 and 7. These capacitances are connected in series, wherein, under an impact of the overvoltage impulse, when a voltage U is applied to the arrester, a voltage $U_1$ will be applied to the capacitance $C_1$ and so to the sparkover gap between the first main electrode 2 and the adjacent intermediate electrode 4. $U_1$ value may be determined, in relative units, according to the formula:

$$\frac{U_1}{U} = \frac{1}{1 + \frac{C_1}{C_0}}.$$

Due to relatively large dimensions of a surface area on the intermediate electrode 4 facing the additional electrode 7, as well as to that dielectric permittivity $\in$ of a solid dielectric is substantially higher than air dielectric permittivity $\in_0$ (usually $\in/\in_0 \approx 2 \div 3$), the capacitance between the intermediate electrode 4 and the additional electrode 7 (that is the capacitance between this intermediate electrode and the ground) is substantially higher than the capacitance between this electrode and the main electrode 2: $C_0 > C_1$ and, respectively, $C_1/C_0 < 1$.

When $C_1/C_0$ value lies in the range $C_1/C_0 = 0.1 \div 1$, the voltage $U_1$ lies in the range $U_1 = (0.50 \div 0.91)U$. Therefore, when the arrester is impacted by the voltage U, the main part (at least, more than a half) of this voltage will be applied to the first sparkover gap between the electrodes 2 and 4. Under the impact of this voltage, $U_1$, said gap breaks down, so that the intermediate electrode 4 closest to the main electrode 2 acquires the same potential as the main electrode 2, while the next intermediate electrode, adjacent to the first intermediate electrode, acquires the potential $U_0$. Then a physical picture of a sparkover gap breakdown repeats itself. In this way, a cascade (that is, sequential) flashover of the gaps between the intermediate electrodes develops, with a spark discharge being formed. Because of the cascade character of the discharge gaps breakdowns, the required low flashover voltage of the activation of the arrester as a whole is ensured.

FIG. 13 illustrates the arrester embodiment with the insulating body 1 shaped as a cylinder with a rounded upper end. The insulating body 1 of this embodiment comprises a hollow cylindrical component and a solid component having the rounded end. The additional electrode 7 located inside the hollow component of the insulating body 1 is also shaped as a cylinder with the rounded upper end. The first main electrode 2 of the arrester is connected to a line conductor 9 of the HEPL via a sparkover air gap 10. In case of the overvoltage on the conductor 9, a flashover initially forms across the sparkover gap 10; as a result, a high voltage becomes applied to the first main electrode 2. Consequent functioning of the arrester is the same as was described above with the reference to FIGS. 1 to 4.

FIG. 14 illustrates the arrester embodiment with the intermediate electrodes 4 arranged along a spiral line passing near a surface of the hollow component of the elongated insulating body 1, wherein the additional electrode 7 (connected with the second main electrode 3) is located inside the hollow component. Such arrangement makes it possible to supply the arrester with a larger number of the intermediate electrodes 4 than in the previous embodiment shown in FIG. 13, and, in this way, to improve further the arc quenching ability of the arrester. According to this embodiment (and also to other embodiments to be described below), both the hollow component and the additional electrode preferably have a circular cross-section, at least, in the zone of location of the intermediate electrodes. Such cross-section simplifies a uniform distribution of the intermediate electrodes 4 over the surface of the insulating body 1 and makes it possible to use the same thickness of the insulation layer in any of radial directions.

Figure 15:
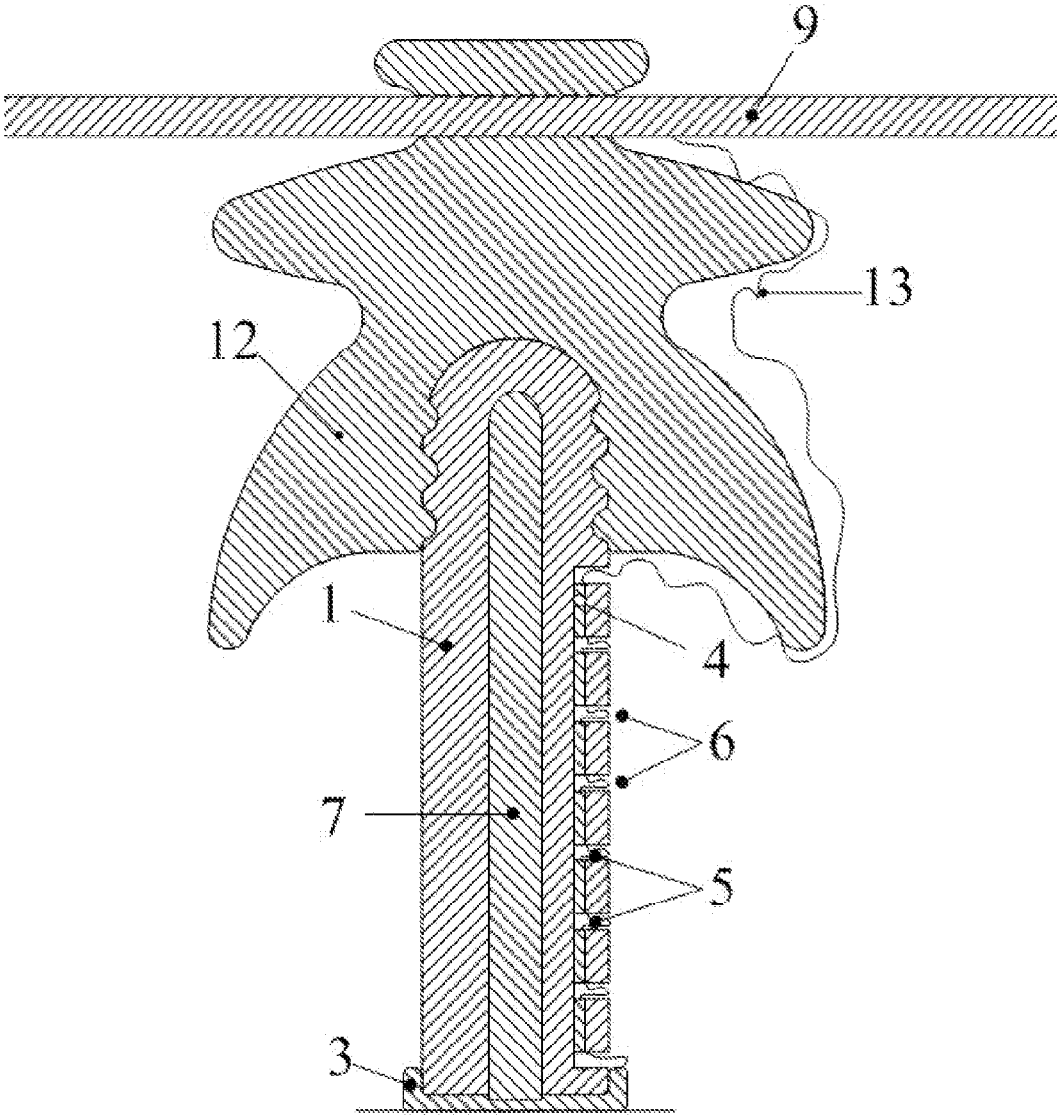
FIG. 15 illustrates a HEPL embodiment according to the invention comprising the arrester configured with a use of the insulating cap and the metal insulator rod.

FIG. 15 shows a HEPL embodiment according to the invention comprising the arrester that is supplied with an insulating cap and a metal rod of the type used in insulators. This arrester embodiment is similar to the embodiments shown in FIGS. 13 and 14, but differs from them in that, instead of the sparkover gap 10, an insulator 12 of the HEPL is used. Thus, in this embodiment the additional electrode 7 of the arrester functions also as the rod to which the HEPL insulator is secured. The insulating body 1 of the arrester functions also as a polymer insulation of the cap of the kind usually employed when installing the HEPL insulator on the rod. Same as in the embodiment shown in FIGS. 13 and 14, both the hollow component of the insulating body and the additional electrode have the circular cross-sections. To simplify manufacturing the arrester, its first main electrode 2 can have the same design as the intermediate electrodes 4.

In case of the overvoltage on the line conductor 9 of the HEPL, a discharge 13 initially develops along the surface of the insulator 12, so that a high voltage becomes applied to the first main electrode 2. This is followed by cascade flashovers of the gaps between the intermediate electrodes 4. Thus, the arrester functions in the same way as described above.

Because the elements of the arrester perform functions of HEPL fastening means, this embodiment is characterized by a small size and low costs.

FIG. 16 shows the arrester embodiment of FIGS. 7, 8 installed on an arm of a long-flashover arrester of a loop type (LFAL) (cf. Russian patent No. 2096882, Nov. 17, 1995, H01 T4/00, and also G. V. Podporkin, G. V. Sivaev. Modern lightning protection of overhead distribution power lines with long-spark lightning arresters rated for 6, 10 kV, <<Electro>>, 2006, No. 1, pp. 36-42).

The LFAL consists of a metal rod bent to form a loop and covered with an insulation layer 11 formed of high-pressure polyethylene. The ends of the insulated loop are fixed in a fastening clamp by which the LFAL is coupled to a rod of an insulator installed at a HEPL's support (not shown). A metal tube surrounding the insulation layer is placed in the middle part of the loop and is connected to a line conductor via a sparkover air gap.

The arrester's functioning is based on employing a creeping discharge effect, which effect ensures a large length of an impulse flashover across the surface of the arrester and thereby prevents a transformation of the impulse flashover into the power arc of the operational frequency.

When an induced lightning impulse is formed in the line conductor, the sparkover air gap between the conductor and the metal tube of the arrester will break down, so that a voltage will be applied to the insulation between the metal tube and the metal rod forming the loop, the rod being at the same potential as the HEPL support.

Due to the applied impulse voltage, a creeping discharge will develop along the surface of the loop insulation from the metal tube (that is from the first main electrode 2) to the arrester clamp (to the second main electrode 3) via one or both ends of the loop arms. Owing to the creeping discharge effect, the arrester's volt-second characteristic is located under a similar characteristic of the insulator, so that, under the lightning overvoltage condition, the flashover develops across the arrester but not over the insulator.

After the impulse lightning current passes, the discharge extinguishes without turning into the power arc, so that a short circuit, the conductor damage and the HEPL outage are prevented.

When the LFAL is used in combination with the arrester of the invention, for example, configured according to the embodiment shown in FIG. 7, 8, the functions of the first and second main electrodes 2, 3 are performed, respectively, by the metal tube and the LFAL clamp, while the hollow component of the insulating body and the additional electrode (both of them having in this embodiment an U-shape profile), are formed, respectively, by the insulation layer 11 and the metal rod of the LFAL. The intermediate electrodes are embedded inside a strip helically wounded around the hollow component on one of the LFAL arms.

In case such combination of the LFAL and of the arrester according to the invention is used in the overvoltage condition, the cascade flashovers of the gaps between the intermediate electrodes develop at a lower voltage than when using only the LFAL. Further, in difference from using only the LFAL, effective quenching of the discharge is ensured before the current at the power frequency passes the zero value. Therefore, the combination of the LFAL and the arrester according to the invention has a lesser size and higher effectiveness than the typical LFAL, and, further, can be used for voltages of higher classes.

FIGS. 17 and 18 illustrate an arrester embodiment produced using a cable technology. As a raw part for manufacturing the arrester, a piece of an appropriate cable with a solid insulation is used, wherein the solid insulation and a cable core form the hollow component of the insulating body 1 and the additional electrode 7 respectively. A metal wire or band is placed on the surface of such cable piece, and then one more solid isolation layer is applied (for example, by extrusion following with welding the new layer to the cable insulation). In this way, the insulating body of the arrester is formed, the body consisting of the cable insulation (forming the hollow component) with the additional insulation layer covering this insulation. After that, discharge chambers 5 are produced (i.e. by drilling or milling) in the insulating body 1, these chambers forming the discharge gaps between the intermediate electrodes 4 and (preferably) between the main electrodes 2, 3 and the intermediate electrodes 4 adjacent thereto. The discharge chambers will have a circular cross-section (if produced by drilling) or, alternatively, a rectangular (for example slit-like) cross-section (if produced by milling). To attain a more compact arrangement of the intermediate electrodes and to reduce the arrester dimensions, said metal band or wire can be helically wound, similar to the arrangement used in the embodiment shown in FIG. 16. In case of the spiral arrangement of the slit-like chambers, it is necessary to check that the chambers corresponding to the adjacent turns of the spiral are not directed towards each other. It was experimentally found that in case this condition is not fulfilled, the discharge channels, when blown out of the discharge chambers, can merge into a common channel located in the air above the insulating body, such merging resulting in a sharp drop of arc quenching ability of the arrester. Therefore, the slit-like discharge chambers in adjacent turns shall be additionally linearly shifted or rotated in relation to each other.

In order to simplify manufacturing of the arrester, the metal wire or band can be replaced by a conducting cord or a band made of carbon fiber. Such replacement will make the step of drilling or milling the discharge chambers substantially easier to perform. The described embodiment is characterized not only by its technological effectiveness, but also by a high mechanical strength.

Figure 19:
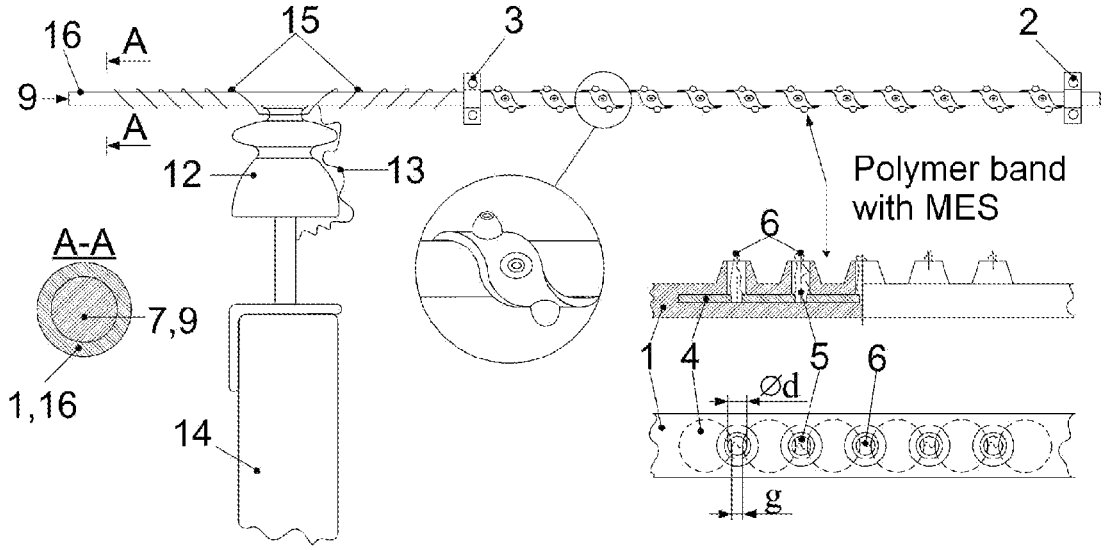
FIG. 19 illustrates a HEPL embodiment according to the invention using a conductor located inside a protective insulation layer.

FIG. 19 shows a fragment of a HEPL with protected conductors and with an arrester embodiment optimized for this particular HEPL. A support 14 made of some conducting material (such as reinforced concrete, steel and the like) carry an insulator 12 to which a conductor 9 having a protective insulation layer 16 is fixed with the aid of metal fastening means 15. A clamp having an electrical contact with the fastening means 15 and acting as the second main electrode 3 of the arrester embodiment of FIGS. 7, 8 is placed on the conductor. The first main electrode 2 is configured as an armored clamp. This clamp, which secures the arrester to the conductor, is in an electric contact with a core of the conductor 9, so that the segment of this core between the main electrodes 2, 3 acts also as the additional electrode 7 of the arrester. The strip, inside which the intermediate electrodes of the arrester are embedded, is fixed to (i.e. helically wound around) a segment of the protective insulation layer 16 located between the main electrodes, which segment functions as the hollow component of the insulating body of the arrester.

When an overvoltage is applied to the conductor 9, a flashover first takes place across the insulator 12, so that the fastening means together with the second main electrode 3 will have the ground (that is zero) potential, while the conductor 9 and, respectively, the armored clamp (the first main electrode 2) will be under the overvoltage potential. This means that the overvoltage will be applied between the first main electrode 2 (the armored clamp) and the second main electrode 3 (the clamp), and this overvoltage will cause down-the-line flashovers of all gaps between the main electrodes 2, 3 and the intermediate electrodes 4. As a result, the core of the conductor 9 via the armored clamp, via the gaps between the intermediate electrodes 4, via the second main electrode 3, via the fastening means 15, and via the discharge channel across the insulator 12 becomes electrically connected to the grounded support 14, so that the lightning overvoltage current will flow along this path to the ground. After the lightning impulse is over, the discharge current extinguishes, without passing to the power arc stage, and the line continue to function without an outage.

Operational capabilities of the arrester according to the invention has been confirmed by experiments in the course of which arresters of two types rated at 10 kV and specially produced for this purpose were tested: 1) the long-flashover arrester of a loop type, LFAL-10, with ring-like intermediate electrodes; and 2) the LFAL-10 without such rings but with the arrester embodiment according to the invention (shown in FIG. 16) wound around one of the arms of the LFAL-10. The tested devices had the following essential features:

- a cable of PIGR-8 type manufactured by the <<Sevkabel'>> plant (St. Petersburg, Russia) had an aluminum core of 9 mm diameter and a polyethylene insulation layer of 4 mm;
- a length of an arm (from the metal tube edge to the clamp edge) was 800 mm;
- the intermediate electrodes 4 were configured as washers with the external diameter of 9 mm and with the thickness of 1 mm; they were embedded in a strip made of silicone rubber;
- the total number of the intermediate electrodes equaled 50;
- a distance between the adjacent electrodes separated by a discharge chamber was selected to be g=2 mm (the reasons for selecting such distance for this embodiment were explained above);
- each of the discharge chambers 5 had a diameter d=3 mm and a height b=4 mm (thus, the tested arrester embodiment according to the invention corresponded to the above-described embodiment 1 intended for the first application variant 1 of the arrester);
- the arrester shown in FIG. 3 was wound around one of the LFAL-10 arms (that is around the above-described cable piece) with a pitch of 30 mm, so that the arrester covered, on a cable piece, a length of 30 cm, that is about one third of a length of the LFAL-10 arm.

The tests has shown that both arresters (the standard LFAL-10 with rings and the LFAL-10 equipped with the arrester according to the invention) are able to protect the HEPL insulator from the lightning discharges; however, the LFAL-10 with rings quenches the follow arc current at the zero current value (so there exists a pause of 3-5 ms in the current flow), while the arrester according to the invention quenches the current immediately after the lightning overvoltage (which lasts only about 5-30 μs) is over and the voltage at the line conductor lowers down to a normal operational value. It means that the arrester functions without introducing any pause in the current flow, which is important when supplying electricity to electronic devices (i.e. computers) sensitive to interruptions in a power supply. An important advantage of the combined arrester according to the invention consists in that its overall dimensions are almost three times less that of the prior art version of the arrester LFAL-10; moreover, the arrester of the invention can be designed for a higher voltage classes.

Thus, the current-shunting device according to the invention has a substantially widened applicability and substantially improved functional reliability. The discharge channel quenching increases with increasing the number of the intermediate electrodes. On the other hand, such increase of the intermediate electrodes number while keeping total length of the discharge gaps unchanged results in an increase of the overall dimensions and cost of the arrester. Therefore, an optimal design of the arrester shall be determined depending on its specific intended application, with relying on the guidelines presented in the above description and taking into consideration such basic parameter as a type of installations or equipment to be protected, a voltage class, a required level of protection, etc.

The above-described embodiments and modifications of the arrester according to the invention and the electric power line configured for using such arresters were described only to clarify principles of their design and operation. It shall be clear for persons skilled in the art that a number of improvements, modifications and changes in the above-presented examples can be made, all of which being within a scope of the attached set of claims. For example, if a discharge between the electrodes of the arrester develops not in the form of a streamer, but in another form, for example as an avalanche discharge or as a leader discharge, some other appropriate formulas may be employed in determining an estimated discharge diameter, probably with resulting modifications of preferred values for minimal distances between the adjacent electrodes.

The invention claimed is:

1. An arrester for lightning protection of elements of electrical facilities or of an electric power line, the arrester comprising an insulating body made of a solid dielectric, two main electrodes mechanically coupled to the insulating body, and two or more intermediate electrodes arranged between the main electrodes and mutually displaced at least along the longitudinal axis of the insulating body, the intermediate electrodes configured to enable a discharge to occur between each of the main electrodes and the intermediate electrode adjacent to said each of the main electrodes and between adjacent intermediate electrodes, characterized in that the intermediate electrodes are located inside the insulating body and are separated from a surface thereof by an insulation layer having a thickness exceeding a precalculated diameter $D_k$ of a channel of said discharge, wherein a plurality of discharge chambers are formed between the adjacent intermediate electrodes, the discharge chambers being open to the surface of the insulating body, and wherein a cross-sectional area S of the discharge chambers in a zone of the discharge channel formation is selected to satisfy a condition $S<D_\kappa \cdot g$, where g is a minimal distance between the adjacent intermediate electrodes.

2. The arrester according to claim 1, characterized in that the minimal distance between the adjacent electrodes is selected to be in a range of 1 mm to 5 mm.

3. The arrester according to claim 1, characterized in that minimal distance between the adjacent electrodes is selected to be in a range of 5 mm to 20 mm.

4. The arrester according to claim 1, characterized in that it is provided with additional discharge chambers formed between each of the main electrodes and the intermediate electrode adjacent to said each of the main electrodes.

5. The arrester according to claim 1, characterized in that the discharge chambers are configured as rectangular or circular openings formed in the insulating body.

6. The arrester according to claim 1, characterized in that the discharge chambers are configured as slits formed in the insulating body.

7. The arrester according to claim 1, characterized in that the discharge chambers are configured as through openings formed in the insulating body.

8. The arrester according to claim 1, characterized in that the insulating body is shaped as a bar, a strip or a cylinder.

9. The arrester according to claim 1, characterized in that the insulating body has an increased thickness in zones where the discharge chambers open to the surface of the insulating body.

10. The arrester according to claim 1, characterized in that the intermediate electrodes are shaped as plates or cylinders.

11. The arrester according to claim 1, characterized in that the intermediate electrodes are made of graphite or carbon fiber.

12. The arrester according to claim 1, characterized in that the mutually displaced intermediate electrodes are arranged along a line coinciding with the longitudinal axis of the insulating body.

13. The arrester according to claim 1, characterized in that the mutually displaced intermediate electrodes are arranged along a line parallel to the longitudinal axis of the insulating body.

14. Arrester according to claim 1, characterized in that an additional electrode is placed inside the insulating body or on the surface thereof opposite to the surface to which the discharge chambers are opened, the additional electrode being connected with one of the main electrodes, wherein a length of the additional electrode corresponds to, at least, a half of the distance between the main electrodes, and wherein a breakdown strength of the insulation between the additional electrode and another main electrode, not connected with the additional one, exceeds a precalculated flashover voltage between the main electrodes.

15. The arrester according to claim 14, characterized in that the insulating body includes a hollow component, wherein the additional electrode is placed inside the hollow component.

16. The arrester according to claim 15, characterized in that the hollow component of the insulating body and the additional electrode have circular cross-sections.

17. The arrester according to claim 16, characterized in that the line along which the mutually displaced intermediate electrodes are arranged is a spiral line.

18. The arrester according to claim 15, characterized in that the insulating body additionally comprises a strip attached to a surface of the hollow component, wherein the intermediate electrodes are embedded inside the said strip.

19. The arrester according to claim 18, characterized in that the strip is helically wound around a surface of a cylindrical hollow component.

20. The arrester according to claim 19, characterized in that the additional electrode and the hollow component of the insulating body are respectively formed as a core and an insulation layer of a piece of an electrical cable.

21. The arrester according to claim 20, characterized in that the hollow component of the insulating body has an U-shape profile, wherein the additional electrode and the hollow component have an equal length, the first main electrode is configured as a metal tube enclosing a curved part of the hollow component, and the second main electrode is mechanically coupled to one or to both ends of the hollow component and is electrically connected with the additional electrode, and wherein the intermediate electrodes are arranged on one or both arms of the insulating body.

22. An electric power line comprising: supports provided with insulators, at least one live conductor coupled to insulators by fastening means, and at least one lightning arrester for the lightning protection of elements of the electric power line, characterized in that said at least one lightning arrester is configured as the arrester according to claim 1.

23. The electric power line according to claim 22, characterized in that the first main electrode of said at least one arrester is connected, directly or via a sparkover gap, to an element of the electric power line to be protected, wherein the second main electrode is electrically connected, either directly or via a sparkover gap, to the earth.

24. The electric power line according to claim 23, characterized in that the live conductor is located inside a protective insulation layer, the first main electrode of the arrester is configured as an armored clamp arranged on the protective insulation layer and electrically connected to the conductor, the second main electrode of the arrester is arranged on a surface of the protective insulation layer and is electrically connected with a metal fastening means for securing said conductor to the insulator of the electric power line, the insulating body comprises a hollow component, wherein said hollow component and an additional electrode of the arrester are configured respectively as a segment of the protective insulation layer and a segment of the conductor, both the hollow component and the additional electrodes being located between the main electrodes, and wherein the intermediate electrodes of the arrester are embedded inside a strip attached to a surface of the hollow component.

25. The electric power line according to claim 24, characterized in that said insulator is arranged on the arrester, wherein the hollow component of the insulating body and the additional electrode of the arrester have circular cross-sections, and wherein the additional electrode is configured as a rod of the insulator while the insulating body is configured as an insulator cap adapted for securing the insulator on the rod.

* * * * *